US006470979B1

(12) United States Patent
Wentworth et al.

(10) Patent No.: US 6,470,979 B1
(45) Date of Patent: Oct. 29, 2002

(54) SONDE HOUSING STRUCTURE

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/616,177

(22) Filed: Jul. 14, 2000

Related U.S. Application Data

(60) Provisional application No. 60/144,545, filed on Jul. 16, 1999.

(51) Int. Cl.[7] ..... E21B 7/04

(52) U.S. Cl. ..... 175/320; 175/45; 175/398

(58) Field of Search ..... 175/61, 398, 399, 175/400, 320, 45; 166/255.2, 65.1

(56) References Cited

U.S. PATENT DOCUMENTS

| | | | | |
|---|---|---|---|---|
| 4,588,243 A | * | 5/1986 | Ramsey et al. | 339/65 |
| 4,694,913 A | | 9/1987 | McDonald et al. | 175/61 |
| 4,907,658 A | | 3/1990 | Stangl et al. | 175/19 |
| 5,155,442 A | | 10/1992 | Mercer | 324/690 |
| 5,633,589 A | | 5/1997 | Mercer | 324/326 |
| 5,795,991 A | * | 8/1998 | Hesse et al. | 73/12.09 |
| 5,799,740 A | * | 9/1998 | Stephenson et al. | 175/62 |
| 5,899,283 A | | 5/1999 | Cox | 175/376 |
| 5,931,240 A | | 8/1999 | Cox | 175/73 |
| 5,934,391 A | | 8/1999 | Cox | 175/73 |
| 5,950,743 A | | 9/1999 | Cox | 175/61 |
| 6,148,935 A | | 11/2000 | Wentworth et al. | 175/398 |
| 6,260,634 B1 | | 7/2001 | Wentworth et al. | 175/61 |

FOREIGN PATENT DOCUMENTS

| | | |
|---|---|---|
| WO | WO 00/11303 | 3/2000 |

* cited by examiner

*Primary Examiner*—David Bagnell
*Assistant Examiner*—Zakiya Walker
(74) *Attorney, Agent, or Firm*—Edward Jorgenson; Philip G. Meyers; Intellectual Property Law, P.C.

(57) ABSTRACT

An apparatus for mounting an electronic device therein for use in an underground boring machine includes an elongated housing having an elongated, lengthwise central cavity opening at one end thereof, a cartridge containing a sonde therein, which cartridge fits in the cavity; and a keying mechanism for securing the cartridge and sonde in a predetermined orientation relative to the housing when the cartridge is inserted into the cavity through the opening. One or more lengthwise fluid passages isolated from the cavity extend through the housing. A sonde housing of the invention may be used with a drill string and bit assembly in directional boring.

20 Claims, 6 Drawing Sheets

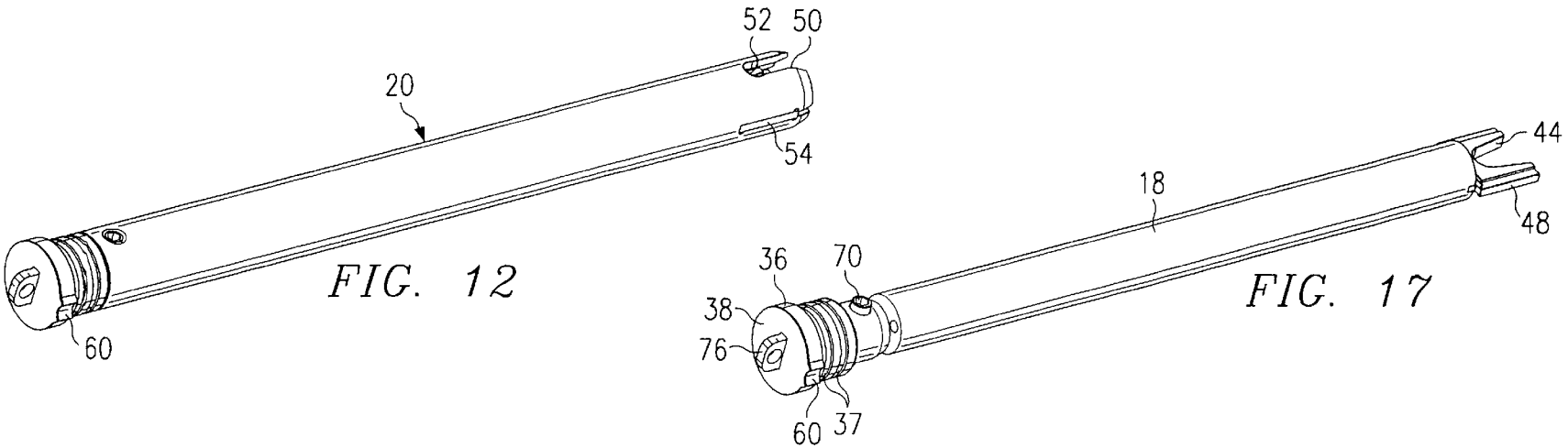
FIG. 12
FIG. 17
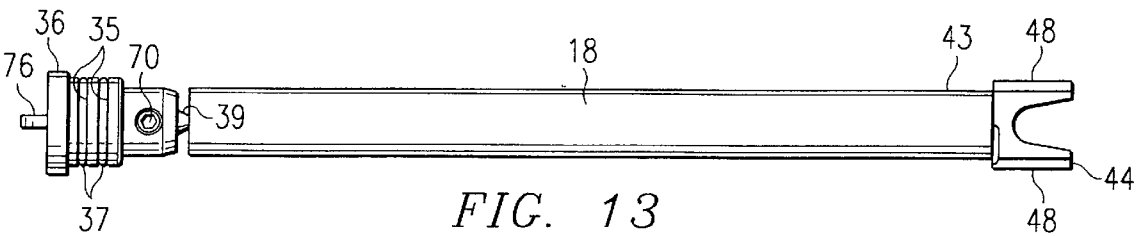
FIG. 13
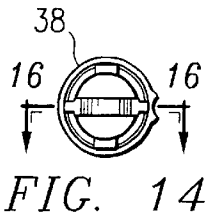
FIG. 14
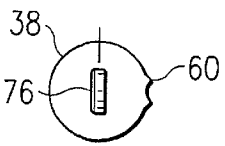
FIG. 15
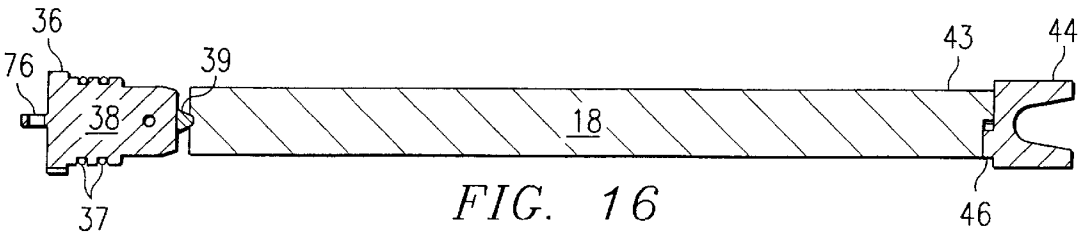
FIG. 16

SONDE HOUSING STRUCTURE

This application claims the benefit of U.S Provisional Application No. 60/144,545, filed Jul. 16, 1999.

TECHNICAL FIELD

The present invention relates to directional drilling, particularly to a sonde housing structure for use with a directional drilling bit.

BACKGROUND OF THE INVENTION

Directional drilling is used for boring under or through obstructions such as roadways, concrete lined waterways and large underground utilities to provide a passageway for utility lines without the need for trenching through or excavating around the particular obstruction. This need has been met by the development of a variety of systems for the installation of underground conduits and pipe bursting/replacement systems.

Directional boring apparatus for making holes through soil are well known. The directional borer generally includes a series of drill rods joined end to end to form a drill string. The drill string is pushed though the soil by means of a powerful device such as a hydraulic cylinder. The drill string ends in a bit having a sloped front face that causes the bit and drill string to deviate in the direction of the sloped face in order to steer. The bit may be pushed and rotated and the same time in order to drill straight. See McDonald U.S. Pat. No. 4,694,913, issued Sep. 22, 1987. A spade, bit or head configured for boring is disposed at the end of the drill string and may include an ejection nozzle for water to assist in boring.

Accurate directional boring necessarily requires information regarding the orientation and depth of a cutting or boring tool. Consequently, a sensor and transmitting device ("sonde") attached to the cutting tool is normally required to prevent mis-boring and re-boring. See, for example, Mercer U.S. Pat. Nos. 5,155,442 and 5,633,589. The sonde includes electronic and electromagnetic components that are sensitive to vibration and may fail if subjected to excessive vibrational shock in service. Since the sonde needs to be positioned adjacent to the cutting or boring head in a drill string in order to provide accurate information regarding the orientation of the cutting head, any vibrations or shock may result in premature failure of the sonde. Additionally, a sonde used in directional boring needs to be housed in a manner that facilitates easy access while simultaneously providing adequate protection to the device.

Sondes have been located inside of a bit assembly, such as shown in Stangl U.S. Pat. No. 4,907,658. More typically, however, the sonde is located in a tubular housing that can be connected and disconnected from the housing. The sonde itself is loaded into a compartment that is isolated from compressed fluid that is supplied to the bit through a separate passage in the sonde housing. See Wentworth PCT Publication No. WO 00/11303, published Mar. 2, 2000, and Cox U.S. Pat. Nos. 5,950,743, 5,934,391, 5,931,240 and 5,899,283 for side load sonde housings wherein a door or cover for the sonde compartment is provided.

End load sonde housings are also known wherein the sonde is loaded into a blind hole at the rear end of the sonde housing, which is then coupled to a trailing component such as a starter rod. A spacer is inserted behind the sonde to hold it in place. These designs avoid the possibility of breakage of a side load door, but replacing the sonde requires disassembly of drill head.

One known side loading sonde housing design is described in commonly-assigned U.S. Pat. No. 6,148,935 and U.S. Pat. No. 6,260,634, the entire contents of which are incorporated for all purposes by reference herein. These patents describes a coupling system known commercially as Splinelok™ wherein the starter rod is connected to the rear end of the sonde housing by a series of interlocking splines that pass torque from the drill string to the sonde housing and bit attached to the front end of the sonde housing.

All sonde housing designs must provide sufficient space for the sonde cavity and for a fluid passage to pass drilling fluid up to the bit, which fluid passage is isolated from the sonde compartment, while maximizing the strength of the housing. The sonde is either battery powered or connected to the surface by a wire which runs through the drill string ("wireline").

A need persists for a sonde housing that provides for increased security and protection of the sonde while simultaneously affording convenient and rapid access to the sonde. The present invention provides an end load sonde housing system that is easier to access than known end load systems.

SUMMARY OF THE INVENTION

According to the invention, an apparatus for mounting an electronic device therein for use in an underground boring machine includes an elongated housing having an elongated, lengthwise central cavity opening at one end thereof. A cartridge containing a sonde fits in the cavity. A keying mechanism is provided on the cartridge and sonde, and also between the cartridge and the housing, for securing the cartridge and sonde in a predetermined orientation relative to the sonde housing when the cartridge is inserted into the cavity through the opening. The sonde housing also preferably includes a lengthwise fluid passage therein which is isolated from the cavity containing the cartridge. According to preferred forms of the invention, an end cap or plug is also provided which holds the sonde cartridge in its installed position and isolates it from contact with the pressure fluid in configurations where the fluid passage and cavity branch from a common end opening of the housing.

A drill head for use in directional drilling according to the invention includes an elongated housing having an elongated, lengthwise central sonde cavity opening at a front end thereof, a keying mechanism for securing the sonde in a predetermined orientation relative to the housing when the sonde is inserted into the cavity through the opening, a closure device for enclosing the cavity with the sonde therein, and a bit assembly mounted at the front end of the sonde housing, such that upon removal of the bit assembly, the cavity containing the sonde can be accessed. Preferably the sonde is contained within a cartridge as described below. A drill string may be directly connected to a rear end of sonde housing without need for an adapter or starter rod. Preferably fluid passages conduct a pressure fluid through the sonde housing to its front end to further fluid passages in the bit assembly. In this arrangement, the closure device comprises a cap which seals the cavity from the pressure fluid, whether or not the cap forms part of a cartridge for the sonde.

A sonde cartridge according to the invention comprises a tube sized to closely receive a cylindrical sonde therein, the tube having alignment openings therein whereby a pin can be used to secure the tube against movement relative to a sonde housing in which the cartridge is to be installed, an end cap which fits into one end of the tube, a keying device which can engage a notch in the sonde so that the sonde may be installed in a predetermined position within the cartridge, and a fastener for securing the end cap to the tube.

The present invention provides an improved end load sonde housing that is inherently stronger than conventional side load configurations and which provides a nonthreaded mechanism for indexing and maintaining the sonde in the proper clockwise position, thereby minimizing the possibility of misboring.

DESCRIPTION OF DRAWINGS

In the accompanying drawings:

FIG. 12 is a perspective view of the cartridge shown in FIG. 8;

FIGS. 13–17 are views comparable to FIGS. 8–12, with the cartridge outer tube removed for clarity;

DETAILED DESCRIPTION

Figure 1:
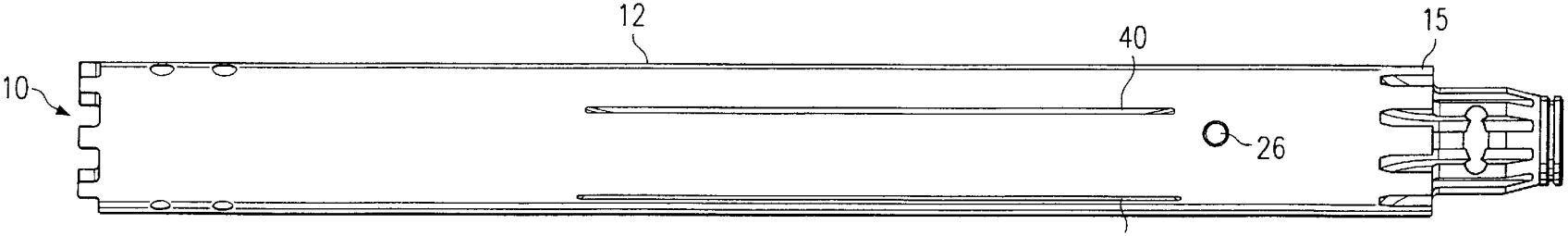
FIG. 1 is a side view of the sonde housing according to the invention.
Figure 4:
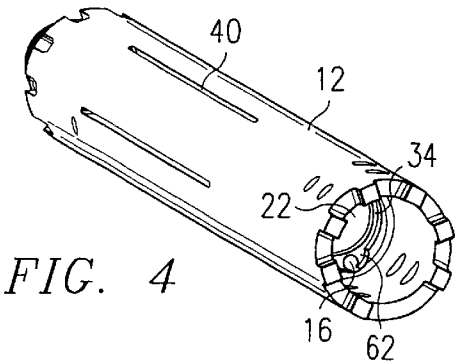
FIG. 4 is a rear perspective view of the sonde housing of FIG. 1.

Referring now to the drawings wherein like reference numerals denote the same and similar parts throughout and in particular FIGS. 1–7, an improved sonde housing 12 according to the invention is illustrated. Sonde housing 12 comprises a generally cylindrical structure with a longitudinal central cavity and, as illustrated, includes joint ends 13 and 15 of non-threaded couplings suitable for coupling the housing to a drill string and mounting an appropriately designed boring bit 14 or other tool. In one embodiment, the sonde housing 12 is configured in accordance with Splinelok™ joint system described in the foregoing patent applications incorporated by reference herein. As set forth in detail below, the geometry of the sonde housing of the invention is especially suited to protecting the combination sensor and transmitting device that comprises a sonde and allowing for transmission of the information collected to the operator via electromagnetic waves or through a wireline.

Sonde 18 transmits radio signals defining the subterranean location of the drill head 14 to an operator and the orientation of the slanted front bit face used for steering. Sonde 18 typically transmits information regarding the position, depth, pitch of the axis relative to gravity and clock position of the apparatus. This information allows the operator to determine which direction bit 14 will go during a steering correction. In order to measure the clock position of bit 14 accurately, sonde 18 must be held in registry relative to particular features on the boring head or bit 14.

Referring to FIGS. 1–7, sonde housing 12 includes an axially extending, rearwardly opening blind hole. This blind hole, henceforth referred to as the cartridge bore or cavity 22, is configured to receive a sonde cartridge 20 (FIGS. 8–12) encapsulating sonde 18. A cross-drilled hole 26 is positioned near the blind end 24 of the cartridge bore 22. A spiral wound roll pin 30 (FIG. 7) is inserted into hole 26. This transverse pin 30 serves to orient cartridge 20 when the cartridge is installed in the cartridge bore 22. At the rear of the cartridge bore 22, there is a profiled, rearwardly facing, generally annular depression 34 surrounding bore 22. Depression 34 is shallow, for example ⅜ inch, and is designed to accept a flange 36 of a cap 38, a component of cartridge 20. Radial slots 40 extend through sonde housing 12 and into cartridge bore 22. Slots 40 permit transmission of the sonde signal into the surrounding ground. Without slots 40, the steel of the housing 12 would shield or block the signals. Alternatively, a wireline (not shown) could be utilized to transmit information. Sonde housing 12 also has an axial fluid passage 16 passing lengthwise through the housing 12 and bit 14 to conduct the drilling fluid around the sonde 18. Fluid is injected through the drill string to a starter rod 56 and then into passage 16 to provide lubrication to the bit and to carry away debris generated during the drilling operation.

Referring now to FIGS. 8–19, cartridge 20 includes an outer tube 42 designed to provide a snug slip-fit over the sonde 18. Preferably, tube 42 is formed from a material such as plastic which allows transmission of the radio signal. A U-shaped guide 44 is provided at front end 43 of tube 42. Guide 44 includes a pair of relieved edges 48 that snap fit into corresponding lengthwise, opposed grooves 54 in tube 42, securing the guide in the tube and providing for proper longitudinal and clockwise alignment of the cartridge 20 and sonde 18 within housing 12. Guide 44 has a small, rearwardly extending tab 46 which fits in a corresponding notch in the end of the sonde 18, thereby preventing rotation of sonde 18 within the cartridge 20 and keying the sonde to a predetermined position relative to cartridge 20.

Upon installation, roll pin 30 passes through the middle of the "U" of guide 44. A pair of opposed, frontwardly opening keyhole-shaped slots 50 at the front end 43 of the cartridge extend through the wall of tube 42. Slots 50 snap over the transverse pin 30 described above, so that the rounded inner ends 52 of slot 50 engage the transverse pin. The mating of the keyhole shaped slots 50 and transverse pin 30 prevent rotation of the cartridge 20 (and therefore of sonde 18) within the cartridge bore 22 of housing 12, maintaining the clockwise orientation of the cartridge within the bore.

After cartridge 20 is inserted into cartridge bore 22, the cartridge is secured in the cartridge bore with an end cap 38. Cap 38 may be formed from any appropriate material, such as steel, plastic or aluminum, so long as the cap 38 is capable of sealing the cartridge bore against the entry of high pressure (2000 psi) drilling mud or fluid and bearing the applied load of the fluid. As will be appreciated by reference to FIGS. 3 an 7, drilling mud or fluid is present at the joint between the sonde housing 12 and the starter rod 56 as it moves from the drill string through the starter rod 56 and into a rear end opening 15 which is slightly larger in diameter than cavity 22 and configured to receive the projecting end of the starter rod therein.

Figure 2:
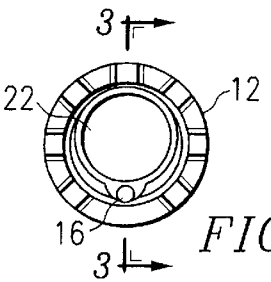
FIG. 2 is a rear end view of the housing shown in FIG. 1.
Figure 3:
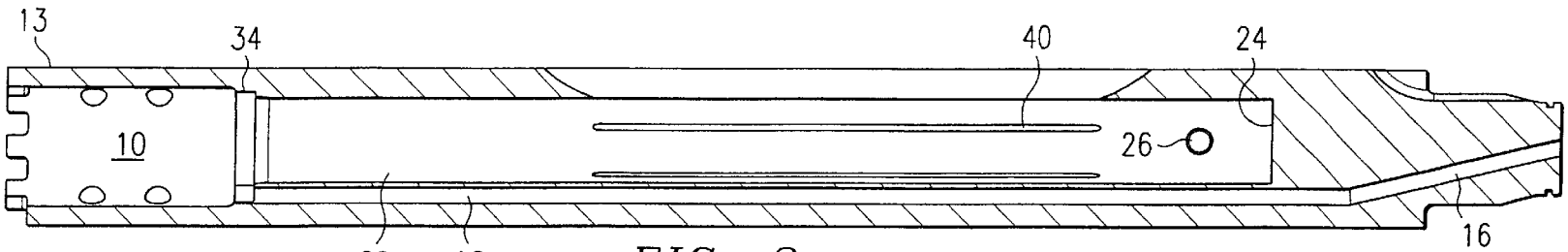
FIG. 3 is a lengthwise section taken along the line B—B in FIG. 2.
Figure 5:
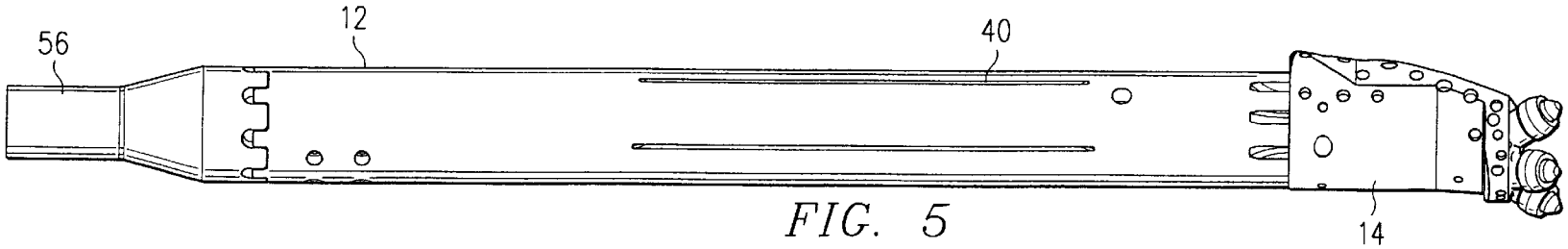
FIG. 5 is a directional drill head using the sonde housing of the present invention.
Figure 7:
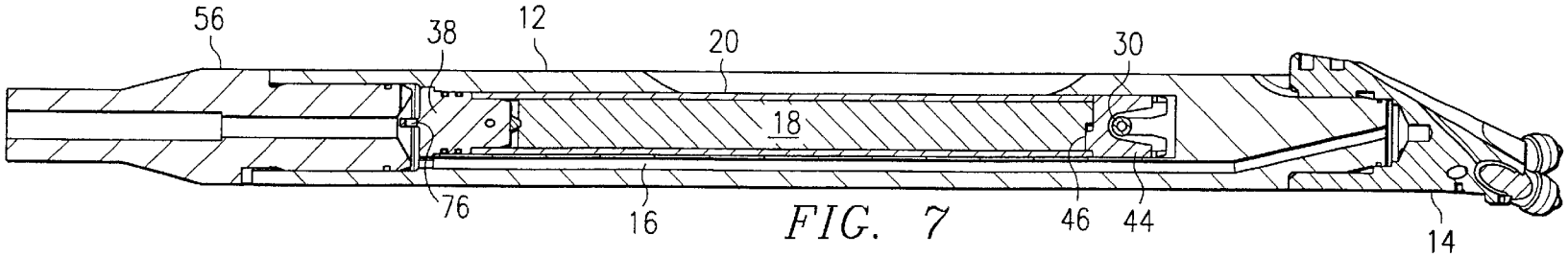
FIG. 7 is a lengthwise section taken along the line A—A in FIG. 6.
Figure 9:
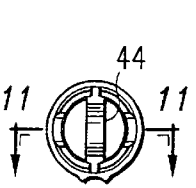
FIG. 9 is a front view of the cartridge of FIG. 8.
Figure 8:
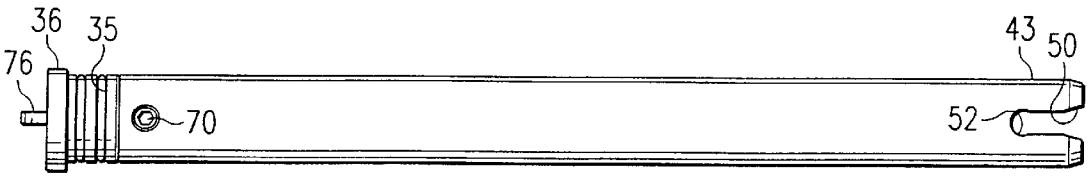
FIG. 8 is a side view of a sonde cartridge according to the invention.
Figure 11:
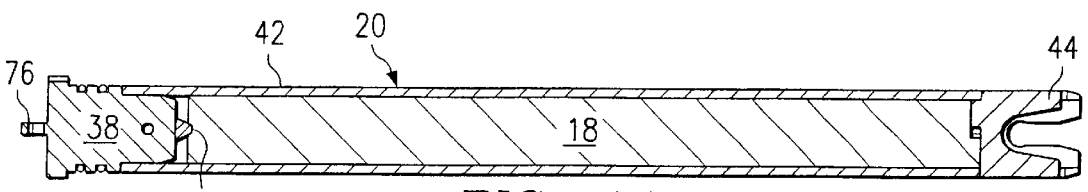
FIG. 11 is a lengthwise section taken along line C—C in FIG. 9.
Figure 10:
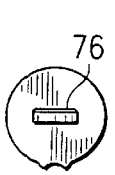
FIG. 10 is a rear (hook end) view of the cartridge of FIG. 8.
Figure 6:
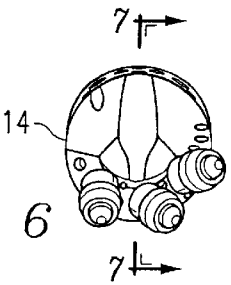
FIG. 6 is a front view of the drill of FIG. 5.

As shown in FIG. 2, passage 16 and cavity 22 both branch from rear opening 15. In this configuration, the high pressure drilling fluid present in the joint between starter rod 56 and sonde housing 20 will produce a load on the back of cartridge 20. For example, at 2000 psi with a bore of 1.62 inches, the applied load will be approximately 4140 lbs. Cap 38 is provided with an annular flange or lip 36 that serves to bear the load upon the rearwardly facing depression 34 in housing 12, protecting sonde 18 from the load. To further aid in protecting sonde 18 against the incursion of drilling fluid into cartridge bore 22, cap 38 is provided with a series of annular grooves 35 along its midsection for mounting elastomeric O-rings 37 which further seal any gap between the cap and cartridge bore 22. Additionally, a rubber nub 39 at the end of cap 38 remote from end flange 36 resiliently engages the rear end of sonde 18.

As previously noted, sonde cartridge 20 receives guide 44 at a position predetermined by slots 54, and guide 44 in turn is provided with indexing tab or key 46 to position sonde 18 in one orientation within the cartridge. In turn, cartridge 20 has keyhole slots 50 which engage transverse pin 30 to position the cartridge in one of two possible orientations, each 180° apart. However, this arrangement still allows the cartridge 20 and sonde 18 to possibly be inverted 180° upon installation in sonde housing 12.

To prevent the cartridge and sonde from being installed in the inverted position, flange 36 of cap 38 is provided with an alignment feature. In the illustrated embodiment, the alignment feature comprises lateral wings or tabs 60. Wings 60 fit only into a profiled portion 62 of recess 34 (FIGS. 3 and 6), thereby aligning cartridge 20 in the proper orientation relative to housing 12. This feature provides the assembler with a means of avoiding a situation where the cartridge is accidentally inverted 180° degrees from the correct clockwise orientation during installation.

Cap 38 is secured to tube 42 by bolts 70 that are received in apertures 72 through the wall of plastic tube 42 and are tightened into threaded holes 73 against a counterbore 74 in cap 38. The heads of bolts 70 function as shear pins to keep cap 38 aligned as well as providing a means to extract the outer tube 42 and sonde 18 from the cartridge bore 22. A hook eye 76 on the outer surface of cap 38 provides means for pulling cartridge 20 out of housing bore 22.

Referring now to FIGS. 20–30, a second embodiment of the sonde housing of the invention is illustrated. In this embodiment, a sonde housing 112 is adapted to be directly connected to the lead end of a drill string (not shown) thereby eliminating the necessity for a starter rod. The elimination of a separate starter rod provides for a simpler construction and assembly. Housing 112 includes a central cavity or bore 122 and, as illustrated incorporates a non-threaded joint 113, such as the Splinelok™ joint for mounting a downhole tool, such as a bit assembly 114. Bit assembly 114, including an interchangeable bit 117 and a bit head 119, is further described in commonly assigned U.S. patent application Ser. No. 09/393,778, filed Sep. 10, 1999, the contents of which are incorporated by reference herein.

Figure 30:
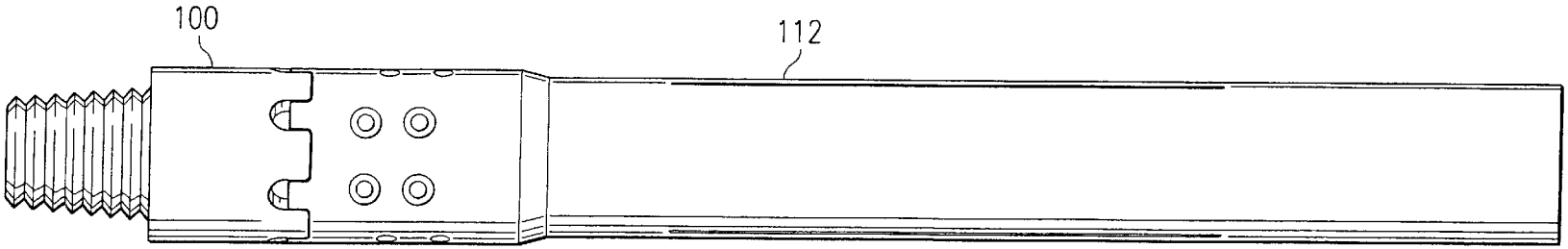
FIG. 30 is a top view of the sonde housing with a threaded male adapter installed.

Turning to FIGS. 20–25, the sonde housing 112 consists of a generally cylindrical body including a cartridge bore 122 extending rearwardly from a forward end 182, the forward end 182 being adapted to receive a drill bit 114 or similar tool. As illustrated, sonde housing 112 is incorporates the Splinelok™ joint system described in pending U.S. patent application Ser. No. 09/212,042, filed Dec. 15, 1998, the disclosure of which is incorporated herein for all purposes. As shown in FIG. 30, a threaded adapter 100 may be mounted on sonde housing 112 upon removal of bit assembly 114 to provide for use of other bits or back reamers tools adapted for threaded connection.

Figures 18, 19, 23, 24, 25:
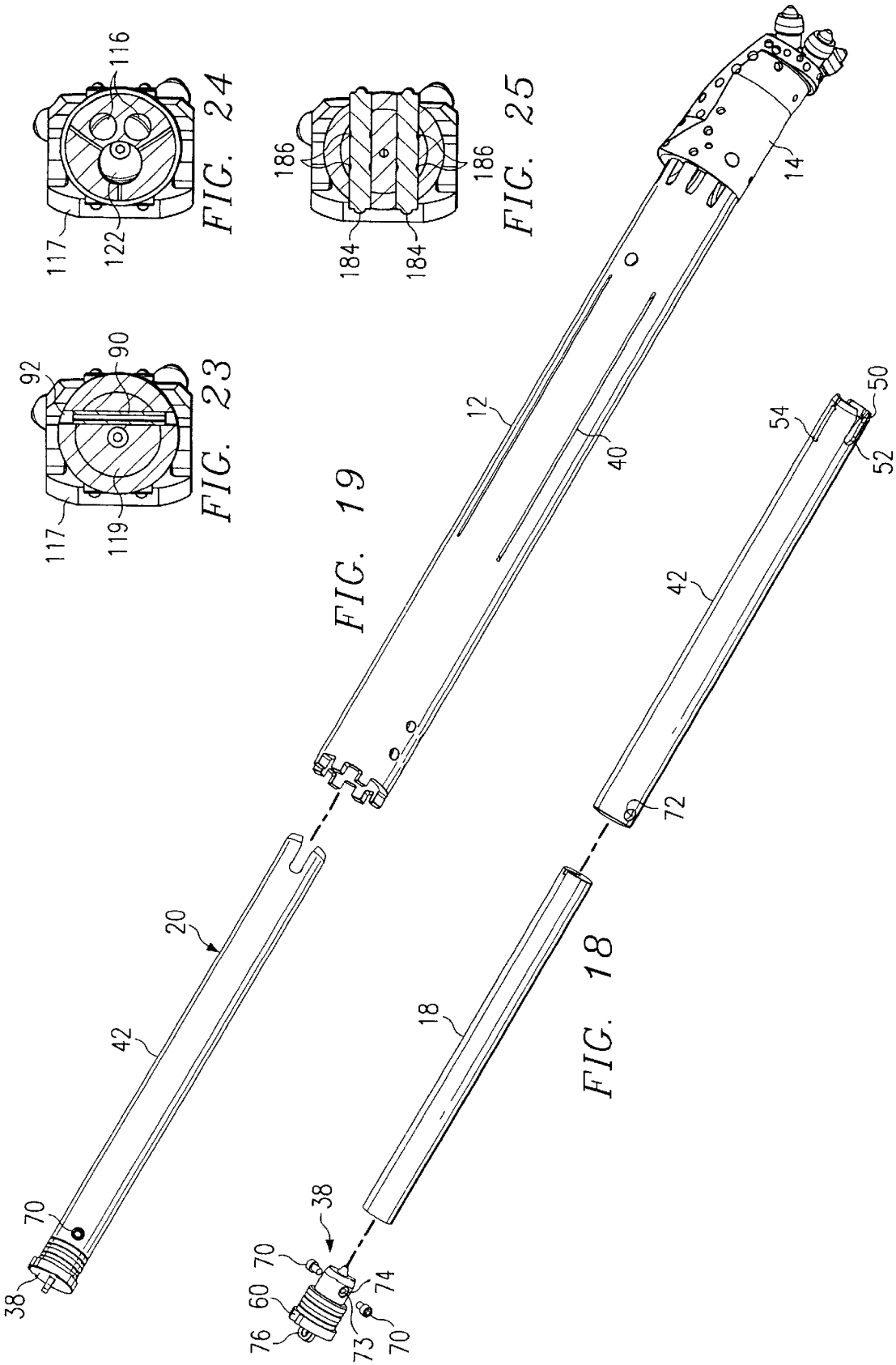
FIG. 18 is an exploded view of the cartridge tube, sonde and cap assembly shown previously.
FIG. 19 is an exploded view of the cartridge, sonde housing and drill bit.
FIG. 23 is a partial cross section taken along line D—D of FIG. 20.
FIG. 24 is a partial cross section taken along line B—B of FIG. 21.
FIG. 25 is a partial cross section taken along line C—C of FIG. 21.
Figure 20:
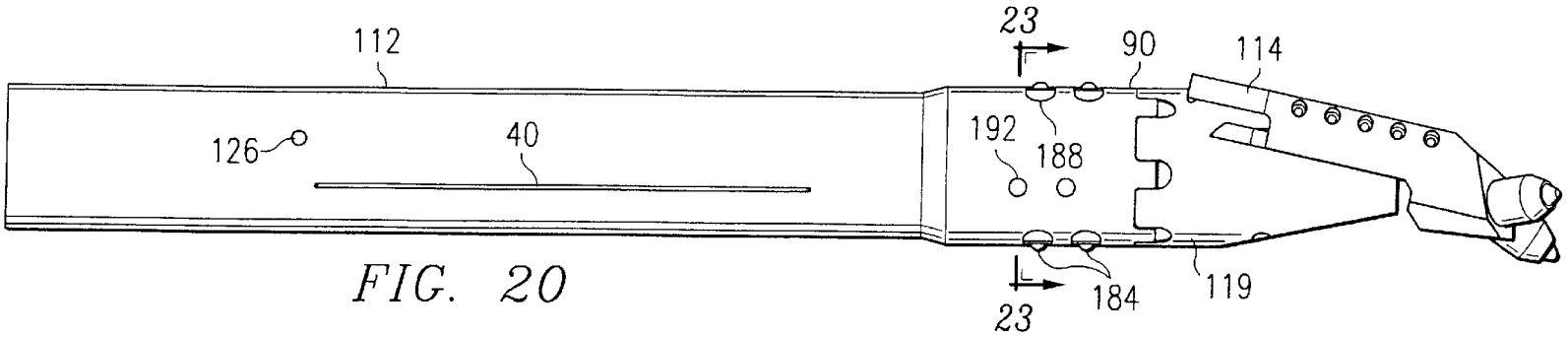
FIG. 20 is a side view of a directional drill employing a second embodiment of the invention wherein the sonde housing functions as a combination of sonde housing and starter rod and wherein the sonde is loaded into the housing from the front end.
Figure 21:
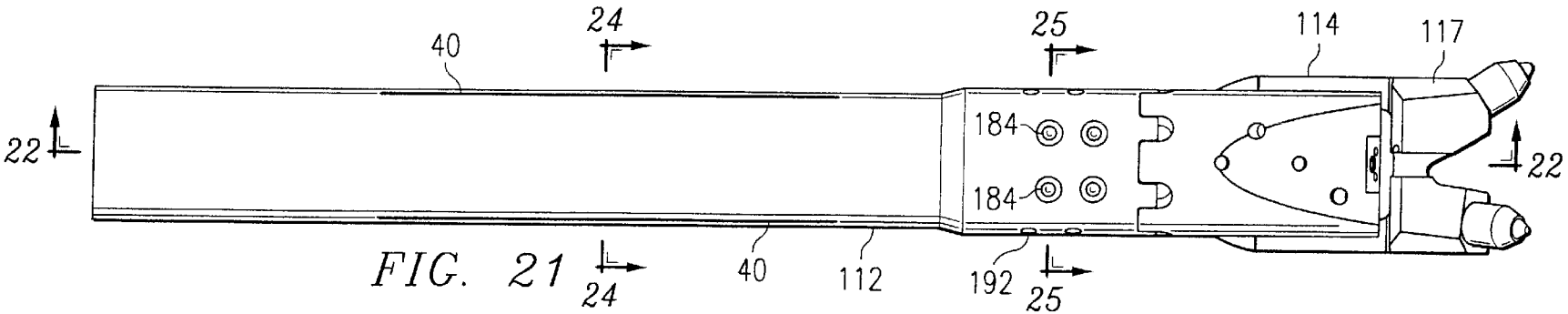
FIG. 21 is top view of the directional drill of FIG. 20.
Figure 22:
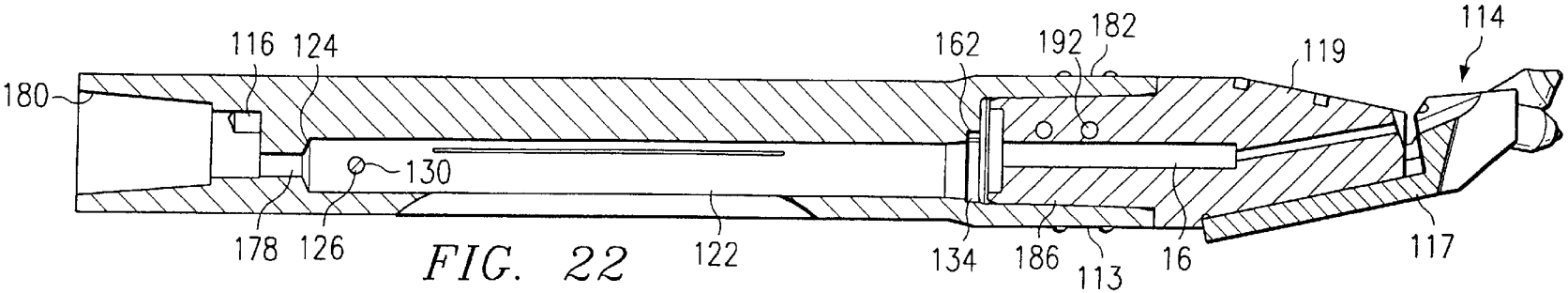
FIG. 22 is a lengthwise section taken along line A—A of FIG. 21.
Figure 26:
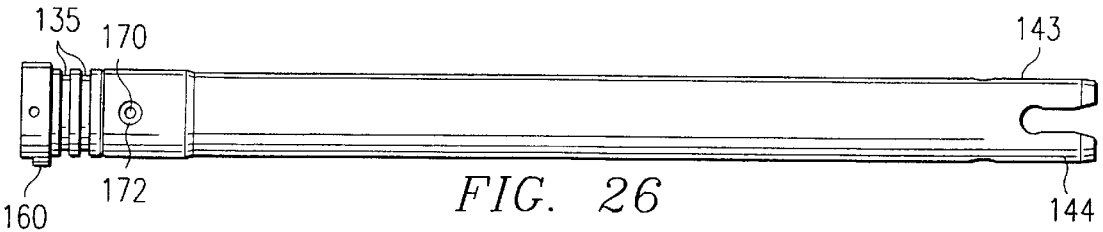
FIG. 26 is a side view of a sonde cartridge in accordance with the second embodiment of the invention.
Figure 27:
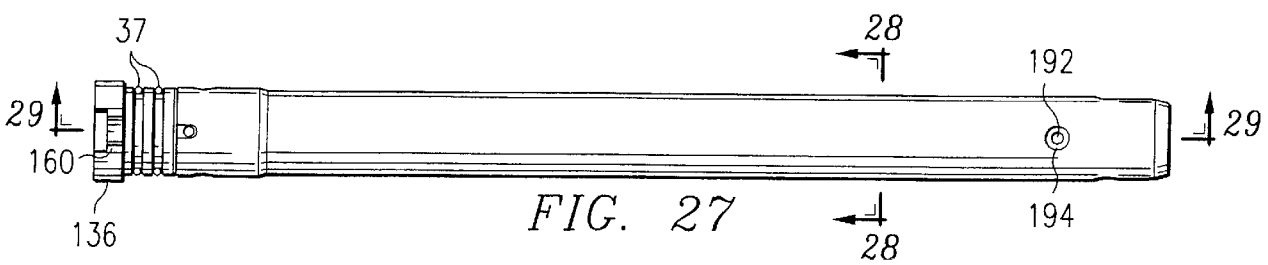
FIG. 27 is a top view of the sonde cartridge of FIG. 26.
Figure 28:
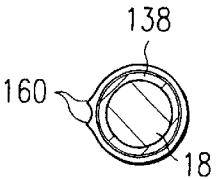
FIG. 28 is a cross section taken along line B—B of FIG. 27.
Figure 29:
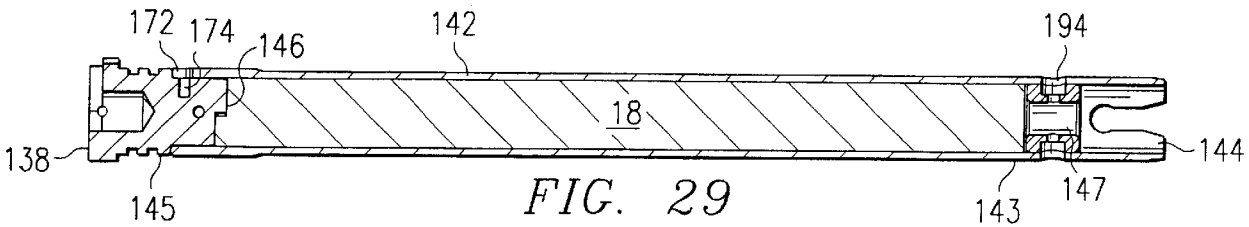
FIG. 29 is a lengthwise section taken along line A—A of FIG. 27.

Sonde housing 112 includes a threaded aperture 180 for receiving a male end of a leading drill rod (not shown) and a passageway 178 for a wireline in case where a wireline-type sonde is used. Passageway 178 is sealed by a plastic or rubber plug, not shown, prior to use to prevent pressure fluid from entering the sonde compartment. Such a plug is either completely solid, or else may be formed around the wire line. As shown in FIG. 24, housing 112 also include a pair of fluid passageways 116 that extend the length of the housing to allow flow of drilling fluid from the drill string through the housing to the bit assembly 114. Cartridge bore 122 extends longitudinally along a portion of the length of housing 112 from the forward end of housing 112. As illustrated, cartridge bore 122 terminates in a blind or, in the case of a wire-line type sonde, a semi-blind end 124.

As best illustrated in FIGS. 20–22, 23 and 25, bit assembly 114 is retained on the forward end of sonde housing with two pairs of solid steel anchor pins 184 that pass through apertures 188 in housing 112. Anchor pins 184 pass through holes in the male end 186 of bit assembly 114 to secure the bit to the housing 112. Anchor pins 184 are formed with a pair of rounded, circumferential grooves 187 that are spaced for alignment with a retainer hole 192 that passes through housing 112 and is substantially perpendicular to apertures 188. Retainer holes 192 are aligned to intersect the grooves 187 of anchor pins 184 so that a retainer 190 inserted in retainer hole 192 fits into grooves 186 of anchor pins 184, locking the anchor pins in position. Preferably, retainers 190 are roll pins, i.e. a flat sheet of steel rolled into a tube. Resilient engagement between retainers 190 and the walls of retainer holes 192 and/or interference with anchor pins 184 maintain retainers 190 in place upon installation. However, other engagement mechanisms between the bit assembly and sonde housing, such as the splined connections shown in the above-cited PCT publication, or even a threaded connection, may also be employed. A threaded connection is, however, more difficult to use and is not preferred. Similarly, bit assembly 114 may be replaced by the bit 14 discussed in connection with the first embodiment above.

Referring now to FIGS. 26–29, a sonde cartridge 120 for use in connection with the front loading sonde housing of the invention includes an outer plastic tube 142 and an end cap 138 generally similar to cap 38 and tube 42 discussed above. A retainer 130 such as a roll pin passes through tube 142 and a transverse hole in sleeve 147 adjacent to a rear end 143 of cartridge 120 to secure cartridge 120 in the sonde housing. Sleeve 147 may be formed from an elastomeric material to provide a resilient cushion for sonde 18.

Cap 138 includes an annular flange 136 designed to fit into a shallow depression 134 (FIG. 22) formed at the forward end of cartridge bore 122. Cap 138 also includes a key or tab 146 at its rear end that indexes against the notch in sonde 18 to position the sonde at the proper clockwise orientation within the tube 142. Sonde housing 112 includes a cross-drilled hole 126 that passes through the housing and cartridge bore 122. A transverse retainer, such as a roll pin 130 is inserted through the cross-drilled hole 126.

Tube 142 includes an aperture 172 that extends through the wall of plastic tube 142 for receiving a bolts or screws 170 in order to secure cap 138 onto the tube. Bolt 170 is tightened into one or more holes 174 in cap 138 to secure the cap 138 and sonde 18 in cartridge 122. The front end of cap 138 may include a recessed crossbar 135 that serves as a handle for pulling cartridge 120 from bore 122. Flange 136 is provided with wings 160 that engage profiled recess 162 of cartridge bore 122. As previously discussed, wings 160 in conjunction with profiled section 162 prevent the cartridge 120 from being accidentally inverted from the proper clockwise orientation when installed in cartridge bore 122. Although guide 44 is absent in this embodiment, keying of the sonde position is still accomplished because the tab 146 and holes 174 are in a predetermined alignment, and a similar keyed connection is maintained between wings 160 and profiled recess 162. Upon installation of cartridge 22, keyholes grooves 150 fit over and stop against transverse pin 130.

Fluid passages 116 terminate at a rear end opening 201 in the bit assembly, which communicates with fluid channels 216 in the bit assembly. The arrangement of the first embodiment is thus reversed, with cap 138 performing the same functions but now facing frontwardly at the joint between the bit assembly and the sonde housing. As such, upon removal of the bit, which occurs frequently, this embodiment of the invention allows ready access to the sonde and the same time.

As will be appreciated by those skilled in the art the sonde housing of the invention provides for securing a sonde in an indexed position with a combination of orienting features that require the installation of the sonde in the proper orientation. Furthermore, as opposed to other end load design, the sonde housing described herein, in combination with the Splinelok™ joint maintains a bit or tool in a known clockwise orientation with the sonde. Thus, as opposed to designs that utilize thread-on type tool joints, the orientation of the tool relative to the sonde is not dependent upon the orientation of a threaded tool connection. This feature represents a substantial advantage over prior art designs that are susceptible to mis-orientation due to the use of a threaded tool connection.

Additionally, the sonde housing described above provides proper sonde orientation in an end loading housing that structurally superior to side load configurations that by design weaken the torsional and bending strength of a housing, require complicated closure mechanisms, and/or are more likely to fail.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. An apparatus for mounting an electronic device therein for use in an underground boring machine, comprising:

an elongated housing having an elongated, lengthwise central cavity opening at one end thereof;

a cartridge configured to fit in the cavity and retain a sonde therein, the cartridge including:

an outer tube and a guide, the guide being configured for engagement with a slot in the tube proximate an end of the tube, the guide including a tab positioned at a first end of the guide and configured to engage the sonde to retain the sonde in a fixed orientation with respect to the tube, the guide having a second end configured to engage the elongated housing and retain the tube in a fixed orientation with respect to the housing; and an end cap configured to close a second end of the tube, the end cap including a flange for engaging the elongated housing and permitting the cartridge to be installed in the cavity only in a selected orientation.

2. The apparatus of claim 1, further comprising a lengthwise fluid passage extending through the housing.

3. The apparatus of claim 2 wherein the fluid passage and cavity branch from a common rear opening of the housing, and the end cap seals the cavity from pressure fluid.

4. The apparatus of claim 1 wherein the end cap is positioned to close the cavity following insertion of the sonde therein, the cap including a flange with a tab configured to engage the elongated housing in a single orientation.

5. The apparatus of claim 1 wherein the guide further comprises interlocking members, the interlocking members comprising a pair of relieved edges configured to engage a pair of longitudinal grooves in the tube.

6. The apparatus of claim 1 wherein the second end of the guide is U shaped and configured to fit over a pin extending transversely across the cavity.

7. The apparatus of claim 1 wherein the tube is made from a material substantially transparent to radio frequency transmissions.

8. The apparatus of claim 1 wherein the tube is made from a plastic.

9. The apparatus of claim 1 wherein the elongated housing is configured for coupling to a bit assembly such that upon removal of the bit assembly, the elongated, lengthwise central cavity can be accessed.

10. A drill head for use in directional drilling, comprising:

an elongated housing having an elongated, lengthwise central cavity opening at a front end thereof;

a cartridge configured to fit in the cavity and retain a sonde therein, the cartridge including:

an outer tube and a guide having a first generally U shaped end configured to engage a pin extending across the cavity, the first end of the guide including a longitudinally extending member configured for engagement with a longitudinal slot proximate a first end of the tube, the guide further including a tab extending from a second end thereof and configured to engage the sonde to regain the sonde in a fixed orientation with respect to the tube, the second end of the guide being configured to engage the elongated housing and retain the tube in a fixed orientation with respect to the elongated housing;

an end cap configured to close a second end of the tube, the end cap including a tab for engaging the elongated housing and permitting the cartridge to be installed in the cavity only in a selected orientation; and a bit assembly coupled to elongated housing.

11. The drill head of claim 10, further wherein a rear end of elongated housing is configured for a direct connection to a drill string.

12. The drill head of claim 10, further comprising fluid passages which conduct a pressure fluid through the sonde housing to its front end to further fluid passages in the bit assembly, and wherein the end cap seals the cavity from the pressure fluid.

13. The apparatus of claim 10 wherein the guide further comprises a pair of relieved edges.

14. The apparatus of claim 13 wherein the tube comprises a pair of longitudinal grooves in the tube configured to engage the relieved edges of the guide.

15. The apparatus of claim 10 wherein the tube is made from a plastic material substantially transparent to radio frequency transmissions.

16. An apparatus for mounting an electronic device therein for use in an underground boring machine, comprising:

an elongated housing having an elongated, lengthwise central cavity opening at one end thereof;

a lengthwise fluid passage extending through the housing, the fluid passage and elongated lengthwise central cavity branching from a common rear opening of the housing;

a cartridge configured to receive a sonde therein;

a keying mechanism for securing the cartridge and sonde in a predetermined orientation relative to the housing when the cartridge is inserted into the cavity through the opening, the keying mechanism including an end cap positioned to close the cavity following insertion of the sonde therein, the end cap including a flange with a tab configured to engage the elongated housing in a single orientation.

17. The apparatus of claim 16 wherein the cartridge further comprises outer tube and a guide having a first generally U shaped end configured to engage a pin extending across the cavity.

18. The apparatus of claim 17 wherein the first end of the guide includes a longitudinally extending member configured for engagement with a longitudinal slot proximate a first end of the tube, the guide further including a tab extending from a second end thereof and configured to engage the sonde to regain the sonde in a fixed orientation with respect to the tube, the second end of the guide being configured to engage the elongated housing and retain the tube in a fixed orientation with respect to the elongated housing.

19. The apparatus of claim 18 wherein the guide further comprises interlocking members, the interlocking members comprising a pair of relieved edges configured to engage a pair of longitudinal grooves in the tube.

20. The apparatus of claim 19 wherein the tube is made from a plastic material substantially transparent to radio frequency transmissions.

* * * * *